United States Patent [19]

McRoskey et al.

[11] Patent Number: 4,901,923

[45] Date of Patent: Feb. 20, 1990

[54] VARIABLE DILUTION RATIO HOSE-END ASPIRATOR SPRAYER

[75] Inventors: Peter K. McRoskey, Del Mar; Paul M. Havlovitz, Escondido, both of Calif.

[73] Assignee: Chevron Research Company, San Francisco, Calif.

[21] Appl. No.: 255,814

[22] Filed: Oct. 11, 1988

[51] Int. Cl.[4] ..... B05B 7/04; B05B 7/30

[52] U.S. Cl. ..... 239/123; 239/310; 239/396; 239/581.1

[58] Field of Search ..... 239/310, 318, 354, 317, 239/365, 367, 581.1, 123, 396

[56] References Cited

U.S. PATENT DOCUMENTS

| | | | |
|---|---|---|---|
| 2,754,152 | 7/1956 | Gilmour | 239/318 X |
| 2,788,245 | 4/1957 | Gilmour | 239/318 X |
| 2,981,284 | 4/1961 | Putnam | 239/581.1 X |
| 2,991,939 | 7/1961 | Packard | 239/310 X |
| 3,319,893 | 5/1967 | Rodgers | 239/581.1 X |
| 3,770,205 | 11/1973 | Proctor et al. | 239/317 |
| 4,418,869 | 12/1983 | Healy | 239/317 |

*Primary Examiner*—Andres Kashnikow
*Attorney, Agent, or Firm*—Burns, Doane, Swecker and Mathis

[57] ABSTRACT

A multiple dilution ratio aspirator sprayer adapted to be connected to a hose for mixing a liquid with pressurized water from the hose and providing a spray of the mixture comprises a container for housing the liquid to be mixed with the water; a mixing head having a nozzle at one end thereof and a garden hose attachment device at the other end thereof; a mixing chamber within the mixing head; a hose for communicating the liquid from the container to the mixing head; a disk having a plurality of apertures therein rotatably mounted in the mixing head to control flow from the container to the mixing chamber; a flow tube communicates liquid in the container to the inlet to mixing chamber through a selected aperture in the disk so that the liquid is diluted with pressurized water at a dilution ratio determined by the size of the aperture aligned with the tube and the mixing chamber; and a cleaning orifice is positioned circumferentially from the mixing chamber so that each of the plurality of apertures may be selectively aligned therewith for cleaning.

23 Claims, 3 Drawing Sheets

VARIABLE DILUTION RATIO HOSE-END ASPIRATOR SPRAYER

BACKGROUND OF THE INVENTION

1. Field of the Invention

The present invention relates to liquid sprayers, and more particularly to sprayers of the aspirator type that proportionally mix a liquid with water under pressure and provide a spray of the liquid/water mixture.

2. Description of Related Art

Liquid aspirators are commonly employed to apply diluted solutions containing chemicals such as pesticides, fungicides, herbicides, and fertilizers to lawns or garden foliage. Typically, sprayers of this type are attached to a garden hose and the pressure of the water delivered through the hose is used to create a vacuum that causes a chemical solution in the sprayer to be aspirated into the water in order to provide a diluted solution that is subsequently sprayed.

In general, sprayers of this type include a container for holding the chemical solution to be diluted and sprayed, and a mixing head, the base portion of which serves as a cover for the chemical container. Such mixing heads generally include an adapter for connecting the mixing head to a standard garden hose, and a hand valve for turning on and off the flow of water from the garden hose. The mixing head also includes a venturi chamber in which water from the garden hose is mixed with undiluted chemical solution from the container.

In principle, as water passes through the venturi chamber, a syphoning or vacuum action, is created by virtue of the velocity of the water passing through the chamber, to draw chemical from the container and into the venturi chamber for dilution with water from the garden hose. The basis of operation of these sprayers is Bernoulli's principle.

Many garden sprayers of this type have a fixed, non-adjustable dilution ratio. In such cases, the chemicals to be used must be diluted and premixed with water in the container to provide a proper concentration of chemical in the final water spray.

For example, U.S. Pat. No. 3,770,205 discloses a sprayer wherein a portion of the incoming water is diverted into a chemical container for mixing with chemicals in the container. The mixture is then drawn back into a mixing head for further dilution with the nondiverted portion of incoming water. Although the dilution ratio of the disclosed sprayer is not adjustable, the sprayer includes a rotatable disk that enables the unit to be changed from a "liquid" mode to a "pellet" mode, depending upon whether the chemicals in the container are in liquid or solid form.

A number of commercially available sprayers do provide for multiple dilution ratios. Multiple dilution ratio sprayers typically do not require chemical premixing and directly provide the desired concentration of chemical in the desired spray. These sprayers are more accurate because they eliminate the need for premixing. Furthermore, liquid chemicals in the container which are not used can be saved and returned to the package (can or bottle) containing the original undiluted chemicals.

Multiple dilution ratio sprayers generally provide dilution ratio variation by either selectively proportioning the size of the opening in the passageway that extends from the chemical container to the mixing (venturi) chamber, or by varying the size of an auxiliary air vent opening which bleeds air into the mixing chamber in order to control the level of vacuum and the resulting syphoning action on chemical from the container. In both cases, a multiple orificed selector, such as a rotatable wheel or slidable stem interposed in the passageway or vent, is used to select the desired dilution ratio.

U.S. Pat. Nos. 3,112,884 and 3,191,869, issued to Robert A. Gilmour, disclose spraying devices wherein the dilution ratio of chemical to water is adjusted by bleeding air into the mixing chamber to control the vacuum level therein. In such sprayers, the size of the air vent opening is adjusted to meet the desired dilution ratio, while the size of the aperture through which chemicals flow into the mixing chamber remains constant.

In practice, it has been found that multiple dilution ratio sprayers that control the air vent orifice size to vary the dilution ratio are not as accurate as those which vary accurately the size of the fluid opening between the chemical container and the mixing chamber.

Another problem encountered with prior art sprayers that require adjustment of the air bleeding into the mixing chamber is that they require at least three openings into the mixing chamber: one for the water, one for the chemical, and one for the air.

In other prior art sprayers, such as the one disclosed in U.S. Pat. No. Re 29,405, the dilution ratio is controlled by changing both the diameter of the mixing chamber and the diameter of the opening through which the chemical flows into the mixing chamber. Such diameters can be changed by rotating a drum mounted in the mixing head, in which drum are contained a plurality of passageways of different diameter.

However, the prior art sprayers that control the dilution ratio by varying either the size of the fluid opening or the air vent, are susceptible to clogging caused by chemicals drying in the control orifice or in narrow passages, thus rendering the sprayers inaccurate or inoperable. Such clogging necessitates disassembling the unit to clean the passages and orifices. In some sprayers, it is not a simple task to remove the orifice selector or to disassemble the unit for cleaning.

A third type of sprayer is disclosed in U.S. Pat. No. 4,475,689. That sprayer includes a rotatable disk containing a plurality of apertures of different sizes. Adjacent each aperture is a small cavity that is connected to the aperture through a small channel. The size of each aperture and each cavity is specifically chosen for a particular dilution ratio. In operation, the disk is rotated until the desired aperture and cavity is aligned with the inlet to the mixing chamber. Undiluted water is then admitted into the selected cavity. That water is used to make an initial dilution of the chemical that is eventually drawn into the mixing chamber through the aperture. Subsequent to the initial dilution, the diluted chemical is then drawn into the mixing chamber where it is further diluted with water before being sprayed.

The use of a dilution cavity adjacent the aperture in the rotatable disk creates certain problems. For example, a special "figure eight" shaped sealing ring is necessary to separately seal the dilution cavity from the aperture, and an additional chamber must be provided adjacent the mixing chamber in order to supply fresh water to the dilution cavity prior to the mixture of the diluted chemical into the mixing chamber. Such a system requires numerous small components, and is thus not only difficult to manufacture, but includes many openings and chambers that are prone to clogging. To further complicate matters, many of these openings and chambers are not accessible to a user, and thus may not be easily cleaned or unclogged.

The clogging and cleaning problem associated with lawn and garden sprayers is further aggravated by the fact that such sprayers are typically used infrequently. Thus, if the sprayer is not cleaned promptly after use, the resulting chemicals may build up in the system so that they are likely to solidify and become difficult to clean.

SUMMARY OF THE INVENTION

In view of the foregoing limitations and shortcomings of the prior art devices, as well as other disadvantages not specifically mentioned above, it should be apparent that prior to the present invention there existed a need in the art for a multiple dilution ratio sprayer that is easy to manufacture, use, and clean.

Briefly described, the present invention includes a multiple dilution ratio aspirator sprayer adapted to be connected to a hose for mixing a liquid with pressurized water from the hose to provide a spray of the mixture to grass, plants and the like. The sprayer includes a container for housing liquid to be mixed with water and a mixing head having a spray nozzle at one end thereof and means for attaching the mixing head to a hose at the other end thereof. The mixing head includes a single axis through-bore comprising a hose inlet and valve chamber, a spray nozzle discharge chamber, and a motive tube portion forming inline, upstream and downstream portions that define a coaxial mixing chamber of larger diameter therebetween to aspirate, mix and dilute liquid from the container with water flowing through the two portions of the motive tube. The sprayer also includes a feed tube for communicating liquid from the container to the inlet of the expansion or mixing chamber through any selected one of a plurality of apertures of different diameters formed in a control disk. By rotation of the control disk relative to the mixing head, each aperture is selectively alignable between the container feed tube and the mixing chamber inlet to control precisely the rate of flow of liquid from the container to the mixing chamber. The volume of the chamber and the size of the aperture through the control disk at a given flow rate through the motive tube controls the dilution ratio over a relatively large range of water flow rates through the motive tube. To assure continued mixing at a selected dilution ratio, a cleaning orifice passing through the mixing head is circumferentially displaced from the inlet to the mixing chamber and the through bore so that upon rotation of the control disk, each of the plurality of apertures may be selectively aligned for cleaning as by a ramrod or wire of appropriate diameter to pass through the orifice as a guide through the selected aperture. Such cleaning assures not only continued suction, but more importantly, continued dilution at the selected ratio during aspiration of treating liquid from the container through the intake tube.

In accordance with a preferred form of the invention, the apertures through the rotatable disk may be as small as 0.0061 inches up to a maximum diameter of, say, 0.076 inches, thus giving a range of dilutions from 1 teaspoon to a gallon of water up to 8 ounces to a gallon of water. In accordance with a method aspect of the present invention, there is provided a method of cleaning the dilution apertures of an aspirator sprayer without disassembling of the mixer head from a liquid container for holding a treating fluid, such as fertilizers, fungicides, bacteriacontrol, insecticides or the like by positioning an aperture to be cleaned lateral to the main passageway and in line with a through passage in the spray head, but out of the pressurized water stream flowing through the spray head, so that by rotation of the control disk, any selected aperture is alignable either with the mixing chamber to control flow of treating fluid into the stream or with the circumferentially displaced cleaning aperture.

The foregoing and other features of the present invention will become apparent and the nature of the invention may be more clearly understood, by reference to the following detailed description of the invention, the appended claims, and the several views illustrated in the attached drawings.

DETAILED DESCRIPTION OF A PREFERRED EMBODIMENT

Figure 1:
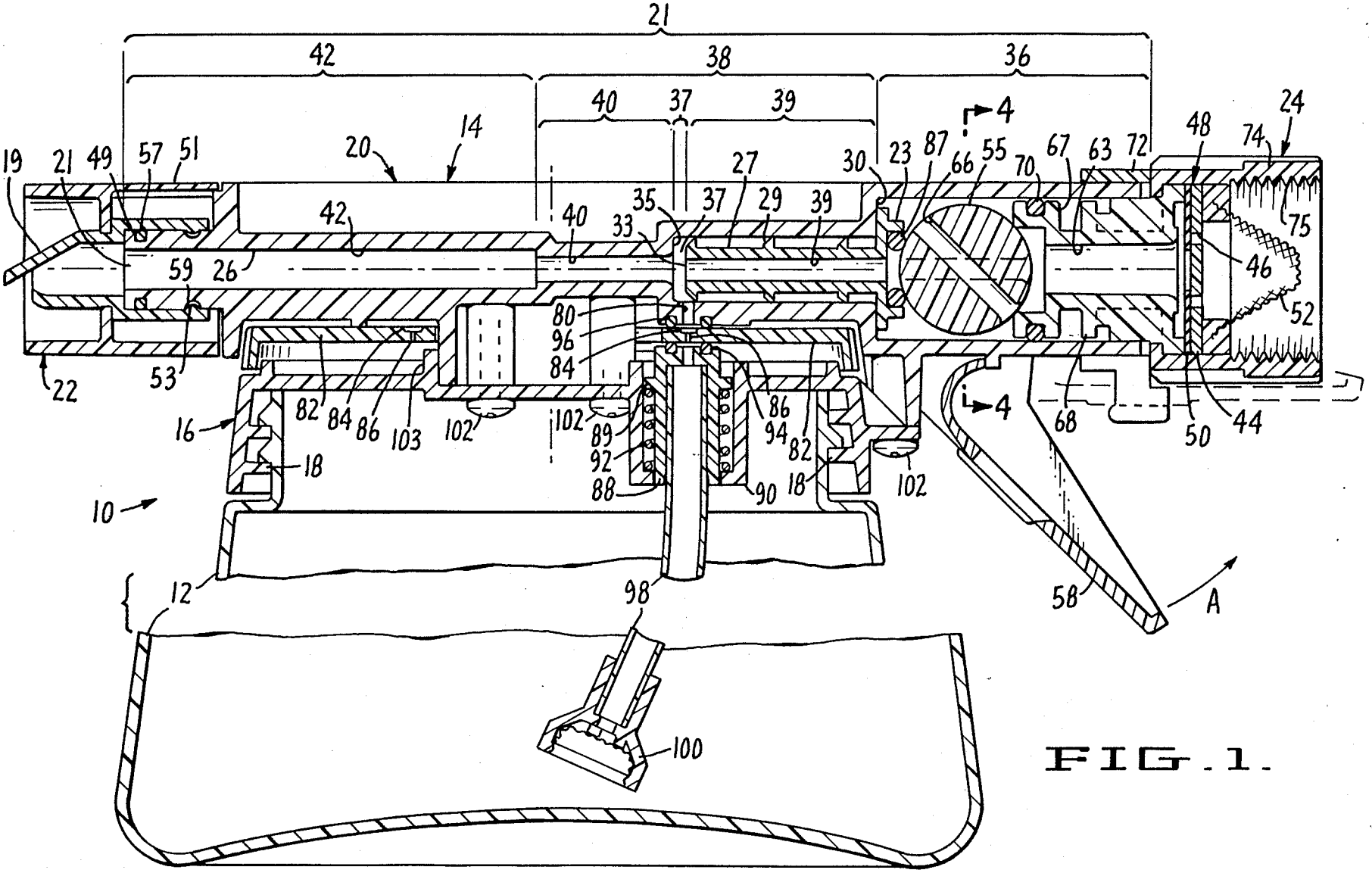
FIG. 1 is a cross-sectional view of the multiple dilution ratio sprayer of the present invention.

Referring now in detail to the drawings, wherein like parts are designated by like reference numerals throughout, there is illustrated in FIG. 1 a multiple dilution ratio sprayer in accordance with the present invention, designated generally by reference number 10. Sprayer 10 includes a container 12 for holding chemicals to be sprayed. Container 12 is preferably formed of a durable, chemical resistant plastic. Sprayer 10 also includes a mixing head 14 that includes a base portion 16 having threads 18 formed internally therein for releasably securing mixing head 14 to the top of container 12. Mixing head 14 further includes a main body 20 secured to base 16, as by screws 102, that mounts a spray nozzle assembly 22 at one end thereof and means for attaching a garden hose such as hose coupling assembly 24 mounted at the opposite end thereof.

Main body 20 is particularly characterized by an internal passageway 21 formed therein as a single longitudinally extending cylindrical bore therethrough. In a preferred embodiment, main body 20 is preferably cast from a rigid, chemically resistant plastic with single through bore 21 forming (1) a control valve chamber portion 36, (2) a central portion 38 forming an upstream motive tube 39, and concentric mixing chamber 37, (3) a downstream motive bore portion 40, and (4) a discharge portion 42 for feeding the mixture of water and chemical to adjustable spray head assembly 22. Main body 20 may also be formed of metal such as aluminum or other comparable materials, either by casting or by cutting a single elongated bore with the four individual cylindrical portions, as by an automatic drilling machine tool.

In greater detail, control valve chamber portion 36 of internal single passageway 21 through body 20 is formed with a relatively large diameter portion to accommodate a ball valve assembly 54 and a threaded garden hose coupler assembly 24, both of which will be described in greater detail below. Central portion 38 of passageway 21 defines both upstream motive tube section 39 and concentric mixing chamber section 37. A single sleeve or tubular insert 27 slidably engages the side wall of central portion 38, as by circumferential ridges 29. Sleeve 27 performs two functions. One function is: its length is proportioned to form precisely the volume of concentric mixing chamber 37 between its downstream end 33 and downstream end wall 35 of central portion 38. Its other function is: flange portion 23 of sleeve 27 forms a valve seat for ball 55 of ball valve assembly 54, against 0-ring 87 and the end wall 30 of control valve chamber 36. The through bore of sleeve 27, forming upstream motive tube portion 39, has substantially the same diameter as integral or molded downstream motive tube portion 40. Hence, mixing chamber 37, between the downstream end of insert 27 and the entry to molded portion 40 forms a chamber of closely controlled volume which is concentric with and substantially larger in diameter than the combined upstream and downstream portions of combined motive tube 38.

Because the diameter of mixing chamber 37 is larger than the diameters of motive tube sections 39 and 40, a vacuum is created in mixing chamber 37 due to the pressure difference. The magnitude of the vacuum is determined by the ratio of diameters of the motive tubes and the mixing chamber.

At the underside of the mixing chamber 37 is an inlet passageway 80 connectable to tube 98 which extends to the bottom of container 12. Tube 98 admits undiluted chemical liquid into mixing chamber 37 in response to the vacuum created by flow through motive tube 38.

Control of water flow through bore 21 is by ball valve assembly 54, when the lever 58 is rotated in the direction of arrow A, so that ball 55 aligns passageway 66 with the inlet to motive tube section 39. Upon such operation, water from a garden hose connected to body 20 by hose coupling assembly 24 passes through upstream portion 39 of motive tube 28 in main passageway 21 to draw chemical liquid from container 12 for mixture with a given volume of water mixing chamber 37. The mixture after dilution is then drawn into the downstream portion 40 of motive tube 28 for emission through nozzle assembly 22 at the end of main body 20.

During the development of the present invention, it was determined that a simple, yet accurate sprayer could be developed that directly controls the dilution ratio by varying only the size of the aperture through which the chemical passes into mixing chamber 37, and that such sufficient accuracy could be achieved by carefully controlling the size of that aperture.

Thus, in order to control precisely the rate of flow of liquid chemical from container 12 into mixing chamber 37, a disk 82, having a multiplicity of selectable apertures 86, is rotatably mounted between base portion 16 and main body 20 of mixing head 14 to bring each aperture into alignment between mixing chamber inlet 80 and tube 98. Each of apertures 86 of rotatable disk 82 includes a recess 84 surrounding the aperture. One of these recesses is unperforated to prevent chemical from entering mixing chamber 25 even with water flowing through motive tube 28.

To seal an aperture 86 between inlet 80 and tube 98, a tubular hose fitting 88 is mounted within a recess 90 formed in base portion 16, and is urged against the bottom of rotatable disk 82 by means of coil spring 92 acting against collar 91. An O-ring 94 seals the top of fitting 88 against the bottom of rotatable disk 82 and 0-ring 96 seals main body 20 against the top of rotatable disk 82. Hose 98 is secured within hose fitting 88 and extends into the base of the container 12 for receiving the chemical solution to be admitted into mixing chamber 37. A filter assembly 100 is mounted at the end of hose 98 in order to prevent any particulate matter that might clog the passageways or a selected aperture 86 from entering mixing chamber 37.

Bolts or screws 102 extend through base 16 of mixing head 14 and a central hub section 103 of main body 20 to secure base 16 to the main body in such a way that disk 82 may be rotated about hub 103 formed as a part of body 20.

Figure 2:
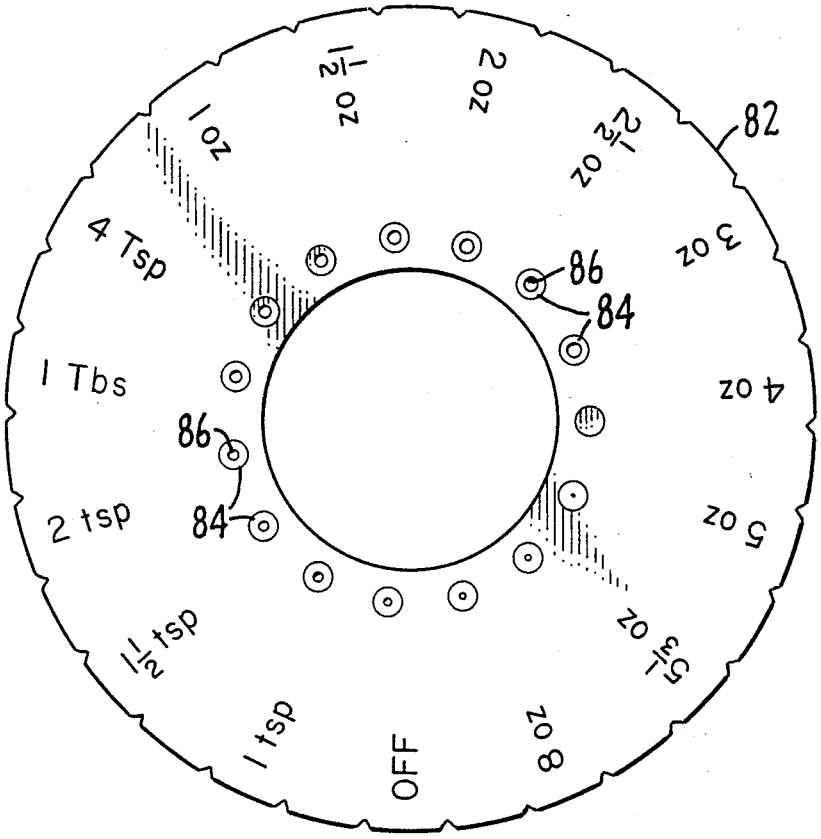
FIG. 2 is a top view of a rotatable disk containing the variable dilution ratio apertures.

Because of the vacuum effect created by the change in diameters from upstream section 39 of motive tube 28 to downstream section 40 through mixing chamber 37, chemicals in container 12 are drawn up into chamber 37 through filter 100 into tube 98 and then through a selected aperture 86 aligned between hose fitting 88 and inlet passageway 80 of main body 20. The particular ratio at which the chemical in container 12 is diluted with water flowing through motive tube 38 is determined by the precise size of selected aperture 86 and chamber 37. As evidenced in FIG. 2, a plurality of apertures are provided in rotatable disk 82. These apertures range in size from approximately 0.0061 inch in diameter for a dilution ratio of about one teaspoon per gallon to approximately 0.076 inch in diameter for a dilution ratio of about 8 ounces per gallon. Table 1 sets forth the approximate diameters and dilution ratios for a

TABLE 1

| Aperture No. | Approximate Diameter | Intended Ratio (per gallon) |
|---|---|---|
| 1 | .0061 | 1 tsp |
| 2 | .0081 | 1½ tsp |
| 3 | .0094 | 2 tsp |
| 4 | .0118 | 1 tbs |
| 5 | .0138 | 4 tsp |
| 6 | .0159 | 1 oz. |
| 7 | .0188 | 1½ oz. |
| 8 | .023 | 2 oz. |
| 9 | .026 | 2½ oz. |
| 10 | .0289 | 3 oz. |
| 11 | .0331 | 4 oz. |
| 12 | .038 | 5 oz. |
| 13 | .041 | 5½ oz. |
| 14 | .076 | 8 oz. |

After contemplating the problems associated with the prior art sprayers and the available molding techniques, it was determined that our improved sprayer could be made by making apertures 86 in disk 82 significantly smaller than apertures in prior art sprayers. For example, whereas the smallest aperture 86 in disk 82 of the present invention may be as small as 0.0061 inches in diameter, the smallest aperture in the commercial sprayer made in accordance with U.S. Pat. No. 4,475,689 is about 0.0125 inches in diameter. Such difference in aperture sizes enables the sprayer of the present invention to be constructed in a novel and efficient design, using a minimum of components.

Disk 82, including a plurality of apertures 86 of such dimensions, is made in accordance with a molding technique generally known to those skilled in the art. However, the pins that are used to form such small apertures 86 in the disk are extremely narrow, and thus subject to breaking or bending. In order to minimize such damage to such pins, the pins are mounted on a spring-biased seat, such that longitudinal forces acting on a pin may be absorbed by the spring-biased seat instead of damaging the pin.

It is also necessary to verify that each aperture is of the desired size in order to ensure the intended dilution ratio. Accordingly, the proper size of the aperture is preferably verified by measuring the resistance that the aperture had to air flowing therethrough. With such a measuring technique, accurate measurements are achieved without having to consider microscopic aberrations or the roundness (or lack thereof) of the aperture.

Figure 3:
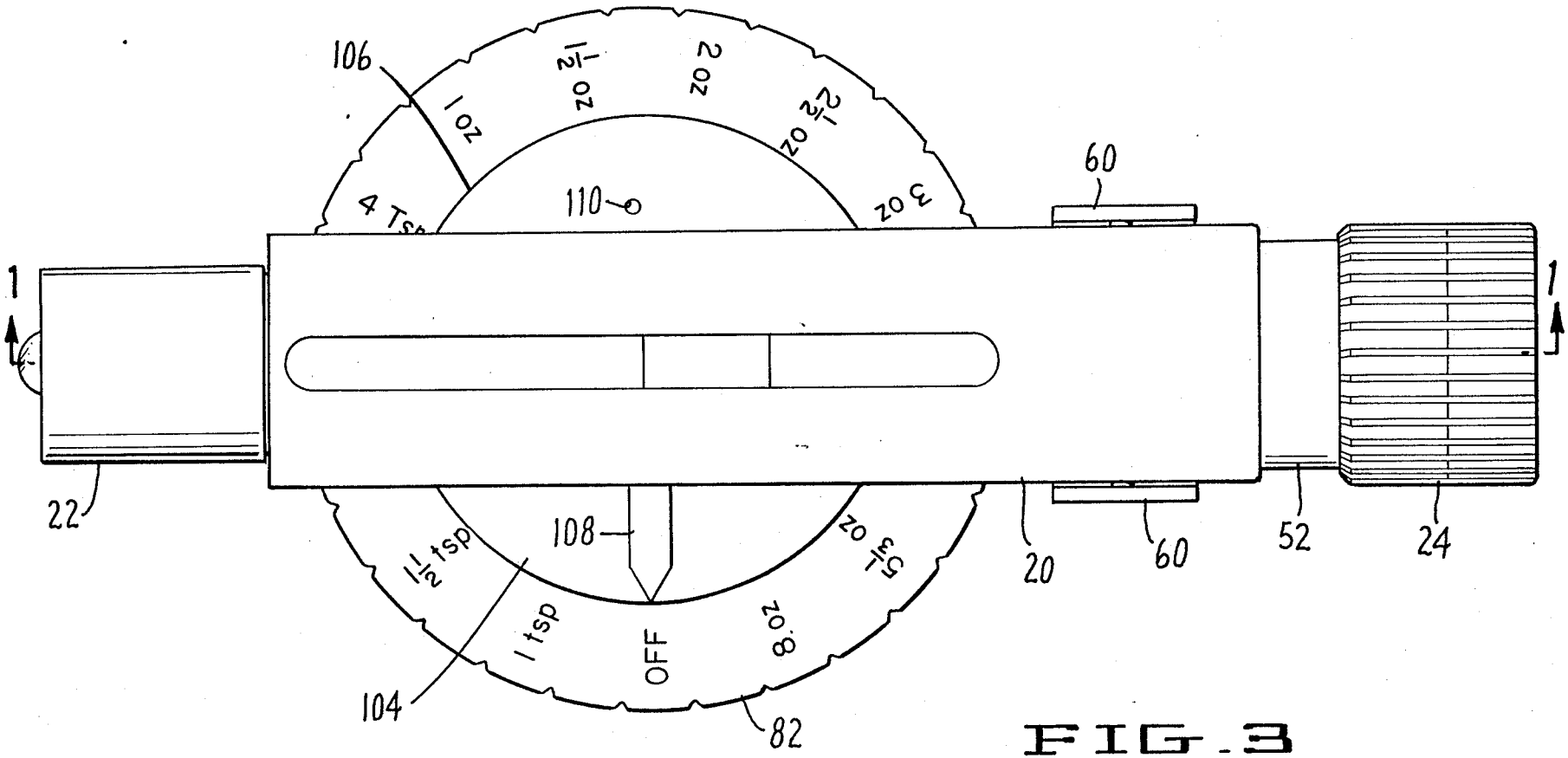
FIG. 3 is a top view of the mixing head of the sprayer.

Turning attention now to FIG. 3, as shown in plan the peripheral flanges 104, 106 of body 20 project laterally from longitudinal bore 21 in body 20 so as to partially cover disk 82. On peripheral flange 104 an indicator 108 is molded or otherwise marked for indicating which aperture of the disk 82 is in alignment with tube fitting 88. In the particular example illustrated in FIG. 3, recess 84, which does not contain an aperture therein, is shown to be in alignment with feed tube fitting 88 and passageway 80. As a result, indicator 108 points to the legend "OFF". The legend is circumferentially placed approximately 90° away from a particular recess 84 and aperture 86, to which the legend pertains.

When recess 84 is so aligned with passageway 80, O-ring 96 forms a seal against disk 82 to prevent any liquid in container 12 from entering mixing chamber 37. Thus in that mode only water from the water hose is emitted from nozzle assembly 22.

According to another significant feature of the present invention, the sprayer is kept in operating order without disassembly to clean out flow control apertures 86 by providing a small clean-cut opening 110 in other peripheral range 106. Opening 110 is circumferentially spaced from inlet 80 to chamber 37 so as to be in alignment with one of the apertures 86 in rotatable disk 82 that is not in alignment with inlet 80. To clean a selected aperture 86, rotatable disk 82 is rotated until that aperture aligns with opening 110. A wire, having a diameter smaller than the smallest aperture 86 is then passed completely through opening 110 and the aperture in order to clean it. By this arrangement, the apertures of disk 82 can be quickly and easily cleaned without need to disassemble the sprayer.

Nozzle assembly 22 mounted on the discharge end of main body 20 preferably includes tubular projection 26 for supporting spray nozzle 19. Tubular projection 26 includes an annular recess 49 for mounting an O-ring seal 57 at the outer end thereof, and an annular recess 59 for receiving an annular detent ring 5 projecting internally from nozzle 19. Nozzle assembly 22 also includes a shroud 51 for rotating nozzle to discharge spray in a desired direction. Assembly 22 is easily removed or reattached to the tubular projection 26 by means of a slight longitudinal force.

Garden hose coupling assembly 24 is a substantially tubular component 65 having sections of varying diameters, one end of which forms a tubular flange 67 that functionally fits within the diameter of valve chamber portion 36 of through bore 21 of main body 20. O-ring seal 70 provides a fluid-tight seal between flange 67 and chamber 36. Collar 72 secures the garden hose coupling assembly 24 to outer surface 68 of chamber 36.

The base end of garden hose coupling assembly 24 includes a rotatable hose coupler 74 having internal threads 75 that are adapted to attach to a standard garden hose coupler (not shown). Conical filter screen 78 is mounted within the opening adjacent threads 75 in order to filter out particulate matter in the water supply or hose that might clog the sprayer.

As indicated, the hose connecting end of component 65 includes an integral ring 63 facing an anti-syphon device 61 comprising a wall member 54 having a plurality of apertures 56 therein separating the open threaded end of the assembly 24 from the passage 63 through tubular component 65. Apertures 56 are arranged in a generally circular pattern in the wall 54. Water entering the garden hose assembly 24 must pass through the plurality of small apertures 56 to enter passageway 21.

To prevent chemicals in container 12 from being syphoned into the water supply through the connected water hose, flexible annular diaphragm 50 is mounted against the downstream side of wall 54. Since diaphragm 50 is held only at the outer periphery, water pressure contacting it through apertures 56 deflects the diaphragm 50 away from wall 54 so that water flows through apertures 56. However, if fluid attempts to flow in the reverse direction, diaphragm 50 closes against the wall 54, to seal apertures 56. In such a position, fluid is unable to flow through diaphragm 50 and effectively prevents reverse flow through the hose assembly 24.

Figure 4:
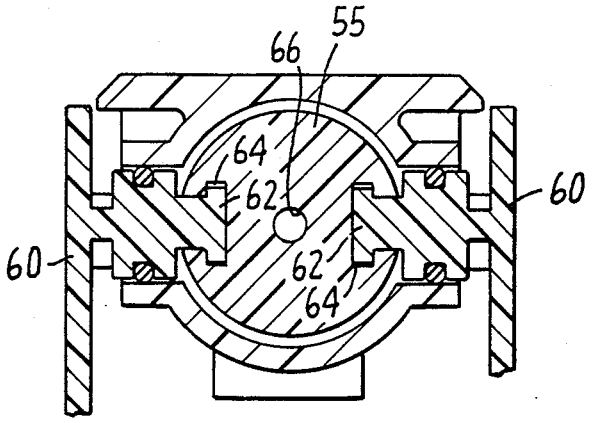
FIG. 4 is a cross-sectional view taken along line 4—4 of FIG. 1.

With reference to FIGS. 1 and 4, a ball valve 54 is located within control valve chamber 36 to control flow of water into bore 21 of main body 20. Valve 54 includes ball 55 that seats on O-ring 87 surrounding the opening through flange 23 of sleeve 27 and is rotatably secured to lever 58 by a pair of side panels 60 (see FIG. 4). Side panels 60 include projections 62 extending therefrom that positively lock within slots 64 in the sides of ball 55. O-ring seals 65 form a liquid tight seal around the projections 62 in order to prevent water from leaking out of valve chamber 36. As noted above, ball 55 includes cylindrical bore 66 extending diametrically through its center. Thus, with lever 58 in the position shown in FIG. 1, bore 66 is aligned so that water cannot flow into through bore 21. However, when the lever 58 is moved in the direction of arrow A, ball 56 rotates on its valve seat to the position shown in dashed lines in FIG. 1 such that the opening 66 is aligned with the garden hose coupling 24 and the central opening of upstream motive tube 39, thus enabling water to flow therethrough. For convenience, a slide lock for holding valve lever 58 in the full flow position is provided by collar 72 being slidably moved axially along the outer surface of 68 valve chamber 36 by catch 73 so that it engages web 69 of lever 58 to lock lever 58 against coupling 74, as shown in phantom.

In the illustrated and a preferred form, the diameter of combined motive tube 38 determines the maximum flow rate of the sprayer. To prevent turbulence in water flowing into the motive bore, the upstream end of the sleeve 27 has a slightly rounded edge.

Also preferably base 16 of mixing head 12 includes a small aperture (not shown) that allows air to be vented into container 12 as liquid is drawn through hose 98 into mixing chamber 25. Such aperture allows air to be drawn into container 12, thereby preventing a vacuum or low pressure condition that would impede withdrawal of chemicals from container 12.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A multiple dilution ratio aspirator sprayer adapted to be connected to a hose for directly mixing and diluting a liquid with pressurized water from the hose to provide a spray of the mixture, comprising:

a container for housing the liquid to be mixed with the water;

a mixing head removably attachable to said container including a cylindrical bore having a single axis extending longitudinally therethrough, said bore terminating in a spray nozzle at one end and means for attachment to a water supply hose at the other end thereof;

a mixing chamber formed within said mixing head;

said single axis cylindrical bore including an upstream motive tube and a downstream motive tube formed upstream and downstream, respectively, with respect to the mixing chamber, said mixing chamber having a larger diameter than said motive tubes, and said mixing chamber being intermediate the ends of said motive tubes;

said upstream motive tube being defined by a sleeve insertable within said mixing head, the length and internal diameter of said sleeve defining the size of the mixing chamber and the diameter of the upstream motive tube, respectively;

tubing means for communicating liquid from said container to inlet means into said mixing chamber in an undiluted form;

a rotatable control disk having a plurality of apertures therein mounted in said mixing head for rotation in a plane parallel to said cylindrical bore;

said disk being interposed between said tubing means and said mixing chamber inlet such that a selected one of said plurality of apertures of differing areas in alignable with said tubing means for controlling the flow of liquid from said container into said mixing chamber;

means for flowing water through said motive tubes to create a vacuum in said mixing chamber and through said control disk aperture to draw undiluted liquid from said container through said tubing means and into said mixing chamber for dilution with pressurized water at a dilution ratio determined by the area of the aperture that is aligned with the tubing means and the volume of said mixing chamber; and ball valve means for shutting off the flow of pressurized water through said motive tubes and said mixing chamber, the upstream end of said sleeve forming a valve seat for a ball element of the ball valve means.

2. A sprayer in accordance with claim 1, wherein the smallest aperture in the control disk is smaller than 0.0118 inches in diameter.

3. A sprayer in accordance with claim 1, wherein the smallest aperture in the control disk is smaller than 0.0094 inches in diameter.

4. A sprayer in accordance with claim 1, wherein the smallest aperture in the control disk is smaller than 0.0081 inches in diameter.

5. A sprayer in accordance with claim 1, wherein the smallest aperture in the control disk is about 0.0061 inches in diameter.

6. A sprayer in accordance with claim 1, wherein said apertures are arranged in a circle on said control disk such that each of said apertures may be selectively aligned with said inlet means by rotating said control disk about an axis concentric with said circle.

7. A sprayer in accordance with claim 1, further comprising a cleaning orifice in said mixing head, said cleaning orifice being circumferentially spaced from said inlet means so that each of said plurality of apertures may be selectively aligned therewith for cleaning.

8. A sprayer in accordance with claim 1 wherein said cylindrical bore includes a control valve chamber section for positioning the ball valve on said single axis and in alignment with an upstream motive tube section, a mixing chamber section, a downstream motive tube section and a discharge section.

9. A sprayer in accordance with claim 1, wherein said upstream and downstream motive tubes have substantially the same cross-sectional area.

10. A multiple dilution ratio aspirator sprayer adapted to be connected to a hose for mixing a liquid with pressurized water from the hose and providing a spray of the mixture, comprising:

a container for housing the liquid to be mixed with the water;

a mixing head having a through bore having a straight line axis aligned with a nozzle at one end of said head and means for attaching a water base at the other end of said mixing head;

a mixing chamber formed between an upstream motive tube and a downstream motive tube within said mixing head, said upstream motive tube including a sleeve member having a flow area therethrough of substantially the same diameter as said downstream motive tube and substantially smaller than the diameter of said mixing chamber, and said mixing chamber having a length shorter than the diameter thereof;

feed tube means for communicating liquid from said container to said mixing head;

control means having a plurality of orifices of differing areas therein rotatably mounted in said mixing head between said feed tube means and said inlet to said mixing chamber for controlling flow of liquid from said container to said mixing chamber;

valve means for controlling water flow through said motive tubes and said mixing chamber, said mixing chamber volume and the diameter of said orifice control the dilution ration with vater flowing therethrough, and a cleaning orifice in said mixing head, said cleaning orifice being circumferentially spaced from said mixing chamber so that each of said plurality of apertures may be selectively aligned therewith for cleaning.

11. A sprayer in accordance with claim 10, wherein said control means is a flat disk rotatably mounted on said mixing head.

12. A sprayer in accordance with claim 11, wherein said plurality of apertures are arranged in a circle on an interior portion of said flat disk such that each of said apertures may be selectively aligned with said inlet means by rotating said control disk about an axis concentric with said circle.

13. A sprayer in accordance with claim 12, wherein the mixing head includes at least one peripheral flange that covers the interior portion of the disk.

14. A sprayer in accordance with claim 13, wherein said cleaning orifice is arranged in one of the peripheral flanges.

15. A sprayer in accordance with claim 10, wherein the smallest orifice in said control means is about 0.0061 inches in diameter.

16. A sprayer in accordance with claim 10, wherein the smallest orifice in said control means is smaller than 0.0118 inches in diameter.

17. A multiple dilution ratio aspirator sprayer adapted to be connected to a hose for directly mixing and diluting a liquid with pressurized water from the hose to provide a spray of the mixture, comprising:

a container for housing the liquid to be mixed with the water;

a mixing head removably attachable to said container including a cylindrical bore having a single axis extending longitudinally therethrough, said bore terminating in a spray nozzle at one end and means for attachment to a water supply hose at the other end thereof;

said single axis cylindrical bore including motive tube means formed therein and having a mixing chamber of larger diameter than said motive tube means, and said mixing chamber being intermediate the ends of said motive tube means;

tubing means for communicating liquid from said container to inlet means into said mixing chamber in an undiluted form;

a rotatable control disk having a plurality of apertures therein mounted in said mixing head for rotation in a plane parallel to said cylindrical bore, at least one of said apertures being smaller than 0.0081 inches in diameter;

said disk being interposed between said tubing means and said mixing chamber inlet such that a selected one of said plurality of apertures of differing areas is alignable with said tubing means for controlling the flow of liquid from said container into said mixing chamber; and means for flowing water through said motive tube means to create a reduced pressure in said mixing chamber and through said control disk aperture to draw undiluted liquid from said container through said tubing means and into said mixing chamber for dilution with pressurized water at a dilution ratio determined by the area of the aperture that is aligned with the tubing means and the volume of said mixing chamber.

18. A sprayer in accordance with claim 17, wherein the smallest aperture in the control disk is about 0.0061 inches in diameter.

19. A sprayer in accordance with claim 17, wherein said apertures are arranged in a circle on said control disk such that each of said apertures may be selectively aligned with said inlet means by rotating said control disk about an axis concentric with said circle.

20. A sprayer in accordance with claim 17, further comprising a cleaning orifice in said mixing head, said cleaning orifice being circumferentially spaced from said inlet means so that each of said plurality of apertures may be selectively aligned therewith for cleaning.

21. A sprayer in accordance with claim 17, wherein said cylindrical bore includes a control valve chamber section for positioning a ball valve on said single axis and in alignment with an upstream motive tube section, a mixing chamber section, a downstream motive tube section and a discharge section.

22. A sprayer in accordance with claim 21, wherein said means for flowing water includes ball valve means for shutting off the flow of pressurized water through said motive tube means and said mixing chamber.

23. A sprayer in accordance with claim 21, wherein said upstream and downstream motive tube sections have substantially the same cross-sectional area and said upstream motive tube section is formed by a sleeve member, the upstream end of said sleeve member forming a valve seat for a ball element of a ball valve in said control valve section.

* * * * *